United States Patent [19]

Giardini

[11] Patent Number: 4,671,706

[45] Date of Patent: Jun. 9, 1987

[54] CONCRETE RETAINING WALL BLOCK

[76] Inventor: Arnaldo Giardini, 9270 Grand-Bois, Saint-Léonard, Canada, H1R 2C2

[21] Appl. No.: 789,014

[22] Filed: Dec. 11, 1985

[30] Foreign Application Priority Data

Oct. 17, 1985 [CA] Canada ..... 493171

[51] Int. Cl.[4] ..... E02D 29/02

[52] U.S. Cl. ..... 405/286; 52/593; 52/608

[58] Field of Search ..... 405/258, 284, 285, 286; 52/593, 596, 604, 608

[56] References Cited

U.S. PATENT DOCUMENTS

| | | | |
|---|---|---|---|
| 3,269,125 | 8/1966 | Moore | 405/286 X |
| 4,341,491 | 7/1982 | Neumann | 405/258 |
| 4,524,551 | 6/1985 | Scheiwiller | 405/286 X |

FOREIGN PATENT DOCUMENTS

| | | |
|---|---|---|
| 786538 | 6/1968 | Canada . |
| 941626 | 2/1974 | Canada . |
| 1097512 | 3/1981 | Canada . |
| 1128327 | 7/1982 | Canada . |
| 1159266 | 12/1983 | Canada . |

*Primary Examiner*—David H. Corbin

[57] ABSTRACT

This concrete retaining wall block comprises a flat, elongated base, two side walls upstanding from the longitudinal sides of the base, a front panel upstanding from the base and joining with the side walls; the top edge of each side wall is provided with a series of notches, the notches of both side walls registering in pairs transversely of the block. The front panel forms a transverse ridge downwardly protruding from the base and adapted to engage any selected notch of a subjacent block, whereby the slope of a retaining wall built of such blocks can be varied and yet the blocks are all laid out horizontally, permitting to use a horizontal foundation for the wall.

2 Claims, 11 Drawing Figures

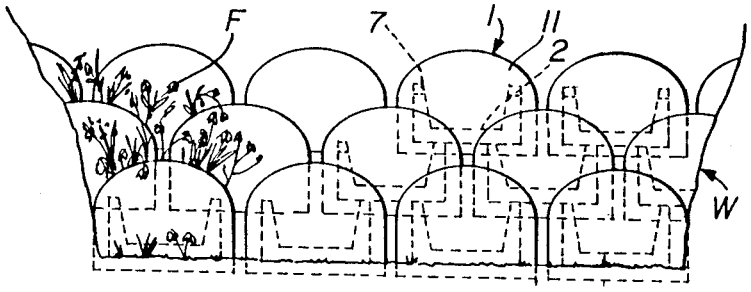
Fig. 7
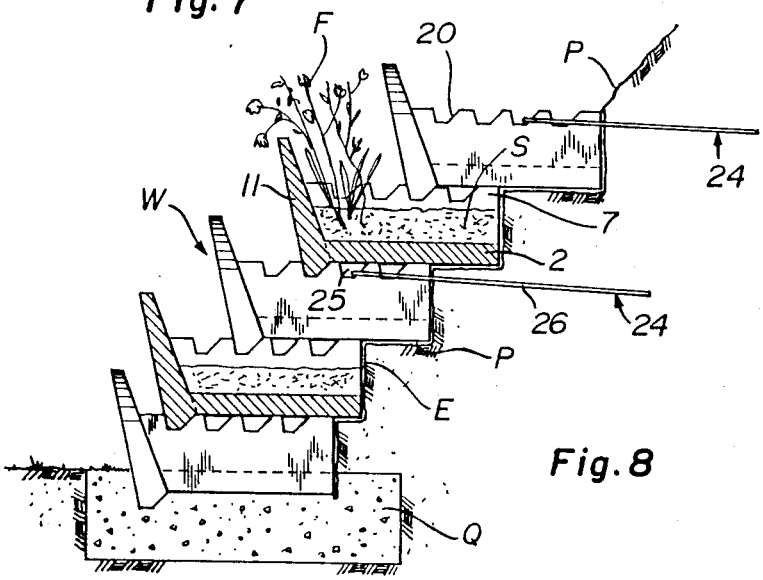
Fig. 8
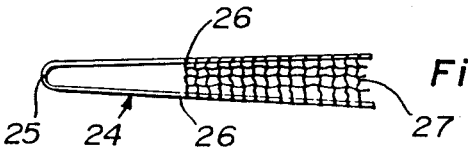
Fig. 9
Fig. 10
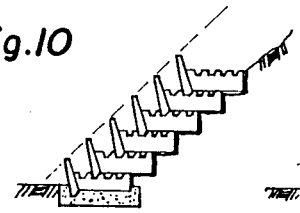
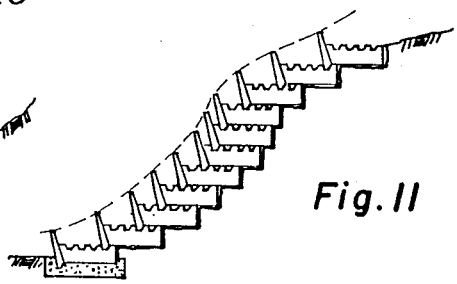
Fig. 11

CONCRETE RETAINING WALL BLOCK

FIELD OF THE INVENTION

This invention relates to concrete blocks used for the construction of retaining walls.

BACKGROUND OF THE INVENTION

Retaining walls made of discrete blocks are frequently used in landscaping of hill sides, on residential, industrial, commercial and private properties. These walls have to be set at an angle, depending on the desired slope and, therefore, the top surface of the wall foundation, whether of concrete, gravel or the like, must be set at a precise vertical angle, in order to properly support the blocks at the desired slope. This is difficult to achieve in practice, especially for erecting high retaining walls.

For reasons of economy and ease of building the wall, it is desirable that at least most the blocks be of the same shape and size and that they be interlocking to resist localized outward pressure. In cold weather locations, the blocks must not be dislodged by the ice action.

Canadian Pat. No. 941,626, issued Feb. 12, 1974 to Giuseppe Risi, shows a block of the character described but which must be set at a precise angle in accordance with the desired slope of the wall. Also, there is no passage for the water drainage of the earth embankment behind the wall and, therefore, ice can dislodge the blocks.

Canadian Pat. No. 1,159,266, issued Dec. 27, 1983 to Steiner Silidur AG and entitled: >>BUILDING BLOCKS<<, describes a block for building retaining walls in the form of a channel open at the rear and having a front facing wall or panel, the channel adapted to be filled with earth which serves to stabilize the wall by planting, the earth also serving as a means for the draining of the embankment behind the wall. The block of this patent has the advantage that it will not become dislodged by ice. However, it does not permit interlocking of the blocks of successive courses with a variable selected horizontal recess, so as to permit to vary the slope of the retaining wall, using the same shape of blocks.

OBJECTS OF THE INVENTION

It is the general object of the present invention to provide a concrete retaining wall block which enables to build from the same size and shape, a retaining wall of variable slope, with all the blocks laid horizontally from back to rear, whereby the blocks can be laid on a horizontal foundation.

Another object of the invention is to provide a block of the character described, having means to be filled with earth for planting purposes and to allow drainage.

Another object of the present invention is to provide a block of the character described, which is made of a one-piece unit and which is of simple and inexpensive construction.

Another object of the invention is to provide simple and inexpensive anchoring members to be used in association with the blocks.

SUMMARY OF THE INVENTION

The concrete retaining wall block of the present invention comprises a flat elongated base, two opposite side walls upstanding from the longitudinal sides of the base and defining a longitudinal channel with said base, said channel opening at the back of the block, a front facing panel upstanding from the base and joining with the side walls to close the channel at the front of the block. The underface of the base of a superjacent block is adapted to rest on at least one top edge of the side wall of a subjacent block, there being provided matching male and female interconnecting means formed at the underface and at the top edges, one of said interconnecting means being repeated longitudinally of the block, whereby the superjacent block can be connected to the subjacent block with its front panel horizontally recessed from the front panel of the subjacent block a variable selected distance. Therefore, the blocks of successively overlying courses can be laid horizontally from front to back, while the slope of the retaining wall built of such block can be varied. Also, the retaining wall can have a variable slope from top to bottom. Preferably, the interconnecting means includes a transverse ridge protruding from the bottom face of the base at the front edge of the base and a series of spaced notches formed at the top edge of each side walls, these notches disposed in pairs transversely of the block. For certain applications, in order to further resist outward pressure exerted by the earth embankment on the retaining wall, anchoring means are provided, said anchoring means consisting of U-shape rod-like members, the bight of which is adapted to be inserted in one of said notches and the legs of which are adapted to extend into the earth embankment rearwardly of the blocks and further including a netting or mesh secured to the legs and adapted to be embedded into the earth.

BRIEF DESCRIPTION OF THE DRAWINGS

FIG. 7 is a front elevation of a retaining wall built with the blocks of FIGS. 1 to 5 inclusive;

FIG. 8 is a vertical section of the wall of FIG. 7;

FIG. 9 is a plan view of an anchor member, shown in side elevation in FIG. 8;

FIG. 10 is a schematic elevation of a retaining wall having a uniform slope; and FIG. 11 is a schematic side elevation of a retaining wall having a variable slope.

DETAILED DESCRIPTION OF THE PREFERRED EMBODIMENT OF THE INVENTION

Figure 5:
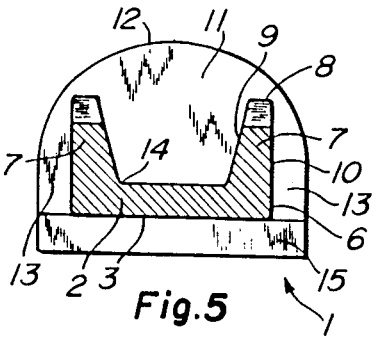
FIG. 5 is a cross-section taken along line 5—5 of FIG. 3.
Figure 4:
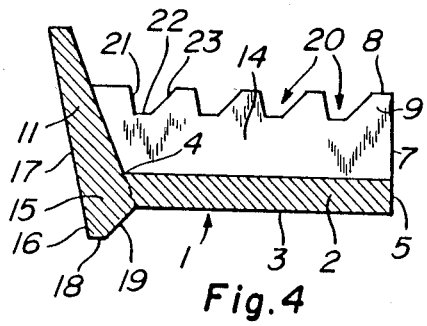
FIG. 4 is a longitudinal section, taken along line 4—4 of FIG. 3.

Each block shown in FIGS. 1 to 5, at 1, is molded as a one-piece block from high strength concrete material and comprises a flat, elongated base 2, having a flat underface 3, a front transverse edge 4, a back transverse free edge 5 and longitudinal side edges 6. In the embodiment of FIGS. 1 to 5, the side edges 6 are parallel to each other. A pair of side walls 7 upstand from the respective longitudinal side edges 6, being parallel to each other, and each has a top edge 8 which is substantially parallel with the underface 3 of the block. Each side wall 7 has an outer face 9 and an inner face 10. A front panel or front-facing wall 11 transversely extends upwardly from the base 2 at its front edge 4; the front panel preferably extends upwardly beyond the top edge 8 of the side walls 7 and has a top rounded edge 12, or other decorative shape. The front panel 11 can be transversely curved, if so desired. The lateral portions 13 of the front panel 11 preferably protrude laterally of the outer faces 9 of the side walls 7. The front panel 11 joins with the front edges of the side walls 7 and closes the front of a channel 14 defined by the base 2, and the upstanding walls 7, this channel being fully open at the top and at the back of the block 1.

For ease in molding the block, both the side walls 7 and the front panel 11 are tapering upwardly in cross-sectional view. Therefore, preferably, the outer faces 9 of the side walls 7 are perpendicular to the base 2, while their innerfaces 10 are mutually upwardly diverging.

In accordance with the invention, there are provided matching male and female interconnecting means formed at the underface 3 and at the top edges 8, with one of said male and female interconnecting means being repeated longitudinally of the block. In the embodiment described, the male interconnecting means is formed by a transversely-extending ridge 15 protruding from the underface 3 of the base 2 at the front of the block and preferably said ridge 15 forms a continuation of the front panel 11, its front face 16 being a continuation of the front face 17 of the front panel. Ridge 15 is further characterized by a flat edge face 18 parallel to the underface 3 and by an upwardly- rearwardly-inclined rear face 19. Ridge 15 is continuous across the width of front panel 11. The female interconnecting means are formed by a series of notches 20, each made across the top edge of each side wall 7. The notches are equally spaced along each side walls, the notches 20 form transversely-registering pairs of notches transversely of the block, each pair being disposed along a line substantially parallel to the front panel 11, the frontmost notches being at the equal distance from said panel. Each notch 20 opens at the top edge 8 and also at the outer face 9 and inner face 10 of each side wall 7. Notches 20 are shaped to receive the front ridge 15 of a superjacent block. For that purpose, the cross-sectional shape of each notch 20 includes a front edge face 21 substantially parallel to the front face 16 of the ridge 15, a bottom face 22 substantially parallel to the base 2 and a back edge face 23 which is upwardly rearwardly inclined, being substantially parallel to the rear face 19 of the ridge 15.

FIGS. 7 and 8 show a retaining wall W built from the blocks 1. As shown in FIG. 7, the blocks are laid in horizontal courses, with the blocks of the next overlying course laterally offset the distance of about half a block relative to the blocks of the underlying course. The ridge 15 of a superjacent block engages a selected pair of notches 20 of the proximate side walls 7 of two subjacent blocks 1. As shown in FIG. 7, there is a small distance between the lateral edges of the front panels 11. This distance can be varied and can be made zero. Also, the block, if so desired, can be laid directly one on top of the other instead of being laterally offset, in which case the ridge 15 of a superjacent block will engage the selected pair of notches of the side walls 7 of the same subjacent block. As shown in FIG. 7, it is seen that the block can be laid horizontally from front to back and, therefore, the blocks of the lowermost course can be laid horizontally on a concrete foundation Q or on a horizontal gravel bed, or the like, which are much easier to build or place in position than a precisely-inclined foundation. By selecting the pair of notches 20 in which the ridge 15 is engaged, one can easily vary the slope of the retaining wall. This slope can be made uniform, as shown in FIG. 10, or non-uniform, from top to bottom of the retaining wall, as shown in FIG. 11 and also in FIG. 8.

The channel 14 of each block can be at least partially filled with plant-growing soil S for the growing of flowers, indicated at F, grass or other plants, which will grow in the free space between the front panel of a subjacent block and the horizontally-recessed front panel of a superjacent block. Thus, the ground is stabilized, and also the blocks, and the retaining wall is also used as landscaping.

Figure 6:
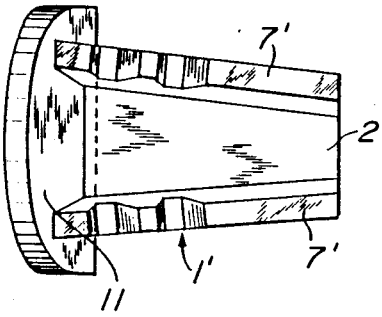
FIG. 6 is a top plan view of another embodiment of the block.
Figure 3:
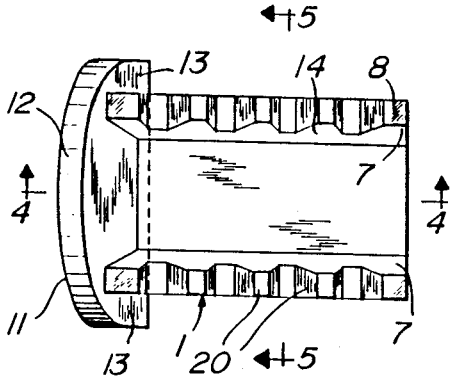
FIG. 3 is a top plan view of the block of FIG. 1.
Figure 2:
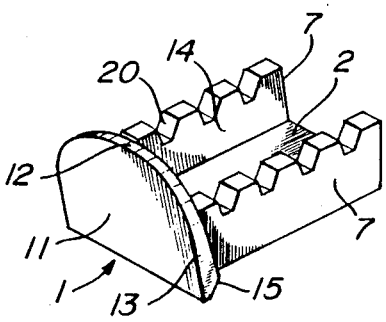
FIG. 2 is a similar perspective view looking from the front of the block.
Figure 1:
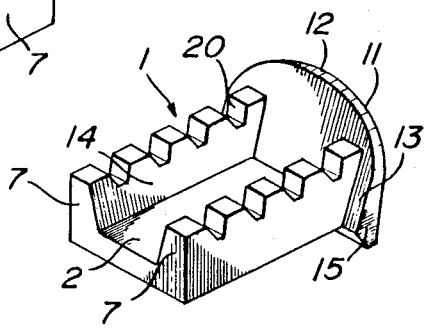
FIG. 1 is a downwardly-looking perspective view of a retaining wall block in accordance with the invention, looking from the back thereof.

During or prior to installation of the wall, the earth embankment E is preferably lined with a water-permeable sheet P, of known construction, which allows outward flowing of the water therethrough, but retains the soil particles, so that erosion is completely prevented. Ice formation cannot raise the blocks, since a superjacent block rests on a minimum surface of a subjacent block. The block of FIGS. 1 to 5 can be used throughout the retaining wall, if such is transversely straight, or mixed with the blocks 1' of FIG. 6 to form corners, such blocks 1' being characterized by the rearwardly converging side walls 7'. Alternately, blocks 1' can be used throughout the transversely straight portions, the corner portions and the concave portions of a retaining wall.

Although the blocks form a gravity wall which, together with the soil filling the same, will normally resist great outward pressure by the embankment E and since, furthermore, the outward pressure exerted on each block is firmly resisted by the interlocking front face 16 of ridge 15 with front edge face 21 of the underlying notch 20, it is sometimes desirable to provide anchor members. Such anchor members will be more often required for very steep slopes of the retaining wall. In such a case, there will always be free notches 20 rearwardly of the ridge 15 of the superjacent block.

Advantage is taken of the free notches. A U-shape anchoring member 24 is provided with a bight 25 and long slightly-diverging legs 26. A netting, or mesh fabric 27, extends between and is secured to the rear portion of the two legs 26. The anchor member can be entirely made of a synthetic resin. The bight portion 25 is inserted in one of the rearmost notches 20 of one side wall 7, with the legs 26 extending rearwardly well beyond the block and on each side of the side wall 7. The mesh 25, which becomes filled with the earth of the embankment E, firmly retains the block. Each side wall 7 can be provided with an anchor member 24, if so desired.

Although shown as upwardly, forwardly inclined, front panel can be vertical with its front face 17 normal to underface 3.

I claim:

1. A concrete retaining wall block comprising a flat, elongated base having a flat underface, a front and a rear edge and longitudinal sides, two opposite longitudinally straight side walls upstanding from the longitudinal sides of said base and defining with the latter a longitudinal channel open at said rear edge, each side wall having an outer and an inner face, a front panel upstanding from said base at said front edge and joining with said side walls to close said longitudinal channel at the front of said block, each side wall having a top edge which is substantially straight and substantially parallel to said underface, the distance between said side walls being less than the length of said base, said front panel protruding upwardly from said top edges of said side walls, the underface of the base of a superjacent block adapted to rest on at least one top edge of the side wall of a subjacent block, a transverse ridge downwardly protruding from the underface of said base at the front edge of the latter, said ridge being continuous transversely of said block, a number of spaced similar notches made in said top edges and opening at said outer and inner faces of said side walls, the notches of both side walls registering in pairs transversely of the block, the ridge of a superjacent block engageable with any selected notch of a subjacent block, whereby a superjacent block can be connected to a subjacent block with its front panel horizontally recessed from the front panel of the subjacent block a variable selected distance, whereby the blocks of successively overlying courses can be laid horizontally from front to back, while the slope of a retaining wall built of such blocks can be varied.

2. A concrete retaining wall block as claimed in claim 1, wherein said two side walls converge towards each other in the rearward direction of said block.

* * * * *